US008177316B2

(12) United States Patent
Muto

(10) Patent No.: US 8,177,316 B2
(45) Date of Patent: May 15, 2012

(54) INK JET PRINTING DEVICE

(75) Inventor: Takeshi Muto, Suwa-gun (JP)

(73) Assignee: Mutoh Industries Ltd., Tokyo (JP)

( * ) Notice: Subject to any disclaimer, the term of this patent is extended or adjusted under 35 U.S.C. 154(b) by 871 days.

(21) Appl. No.: 12/223,525

(22) PCT Filed: Feb. 4, 2007

(86) PCT No.: PCT/JP2007/000054
§ 371 (c)(1),
(2), (4) Date: Aug. 1, 2008

(87) PCT Pub. No.: WO2007/097114
PCT Pub. Date: Aug. 30, 2007

(65) Prior Publication Data

US 2009/0021549 A1 Jan. 22, 2009

(30) Foreign Application Priority Data

Feb. 22, 2006 (JP) ..... 2006-045881
Feb. 22, 2006 (JP) ..... 2006-045882

(51) Int. Cl.
*B41J 2/01* (2006.01)

(52) U.S. Cl. ..... 347/16; 347/102

(58) Field of Classification Search ..... 347/102, 347/212, 16
See application file for complete search history.

(56) References Cited

U.S. PATENT DOCUMENTS

| | | | | |
|---|---|---|---|---|
| 6,623,097 | B2 * | 9/2003 | Okada et al. | 347/21 |
| 7,063,869 | B2 * | 6/2006 | Yamazaki et al. | 427/66 |
| 7,384,140 | B2 * | 6/2008 | Kojima et al. | 347/102 |
| 7,674,494 | B2 * | 3/2010 | Yamazaki et al. | 427/66 |
| 2002/0041302 | A1 | 4/2002 | Okada et al. | |

FOREIGN PATENT DOCUMENTS

| | | |
|---|---|---|
| JP | 6-246910 | 9/1994 |
| JP | 2001-341296 | 12/2001 |
| JP | 2004-174887 | 6/2004 |

OTHER PUBLICATIONS

International Search Report issued Mar. 20, 2007 in the International (PCT) Application of which the present application is the U.S. National Stage.

* cited by examiner

*Primary Examiner* — Huan Tran
(74) *Attorney, Agent, or Firm* — Wenderoth, Lind & Ponack, L.L.P.

(57) ABSTRACT

A blower is disposed at least at backward side of printing moving direction of the head unit, out of two sides of the head unit. The blower has air nozzles for injecting compressed air perpendicularly to the printing plane, and the bottom of the blower is provided with a curved plane and a parallel plane so that the compressed air injected from the air nozzles may be bent in a direction at right angle by Coanda effect. The curved plane and the parallel plane generate a horizontal air stream parallel to the printing plane, toward a direction departing from the adjacent head unit, at the downside of the blower. The printing device, using the ink jet head, dries the ink on the printing medium by the horizontal air stream injected from the blower while printing on the printing medium.

14 Claims, 10 Drawing Sheets

INK JET PRINTING DEVICE

This application is a National Stage application of PCT/JP2007/000054, filed Feb. 4, 2007, the entirety of which is incorporated herein by reference.

BACKGROUND OF THE INVENTION

I. Technical Field

The present invention relates to a printing device for printing on a printing medium by an ink jet type printing head, drying ink drops formed on the printing medium by a blowing device.

II. Description of the Related Art

When printing by an ink jet printing device, drying of ink drops on the medium is an inevitable issue. There is no problem if the printing medium allows a quick permeation of the ink, but if printing on resin, plastic or other printing medium that does not allow smooth permeation of ink, fixing of ink is mainly achieved by evaporation of the solvent (dissolving medium) of the ink. It hence takes time in fixing of ink, and promotion of ink fixing is an important matter. Usually, the ink is evaporated in the air above the printing medium, and evaporation is not promoted easily, and in particular when printing is operated in a closed space, the air above the printing medium is not moved, and fixing of the ink is not encouraged.

Hitherto is known a recording device for printing after blowing out the air containing the ink mist or evaporated solvent (dissolving medium) staying near the printing medium before printing by the wind from blowers disposed at both sides of the recording head (see, for example, Japanese Unexamined Patent Application Publication No. 2005-212323). Also, an ink jet device having an ink jet head provided with a gas blowing device for blowing always gas to the substrate surface, and blowing out the solvent evaporated from the ink drops on the substrate is known (see, for example, Japanese Unexamined Patent Application Publication No. 2001-341296).

SUMMARY OF THE INVENTION

When a strong wind is directly blown to the printing medium right after printing, since the ink is blown before it is dried (fixed), and the ink flows in the wind blowing direction, and the ink may be dried in this state, the printing quality may be poor. If the air blown from the blower is contaminated, adverse effects may occur in the printing results. When evaporation of the ink is promoted by blowing wind to the printing medium, to improve the efficiency of blowing effect, it is desired to blow from a position closer to the printing medium. For example, in the case of a structure having a hole opened in the tube as disclosed in Japanese Unexamined Patent Application Publication No. 2001-341296, there is no problem if the wind is blown obliquely downward, but when blown parallel to the printing surface, the downside portion of the tube is present beneath the tube hole.

Not limited to this structure, supposing to blow air parallel to the printing surface by providing a hole in an object, the downside portion of the blow opening is always present. Therefore, in the printing device using an ink jet head, the distance between the printing medium and the paper surface is very close, and it is physically impossible to project any object to a lower position than the head, and it is extremely difficult to move only the air in parallel in a position lower than the ink jet head.

In the ink jet, when the blower is used near the head, since the printing method is designed to discharge very small droplets of ink, the air flow during printing may have delicate effects on the ink during flight, and adverse effects may appear in the print. Hence, desirably, wind should not blow beneath the head.

In ordinary control of mounting a blower on the head and promoting drying of ink on the printing surface, the blower is always used in blowing state. There is no problem while air is blown on the printing medium, but when air is blown in an undesired position, for example, a purge area where the head discharges ink, or when moving to a position remote from the printing area, mist or dust may be wastefully scattered about the printing device. Or when a fan is used as the blower, it is not stopped immediately when driving is stopped, and it is not suited from the viewpoint of on/off control of blowing.

The invention is devised to solve these problems of the prior art.

To achieve the object, the invention presents an ink jet printing device including a printing medium conveying a mechanism having a support surface for supporting a printing medium, for conveying the printing medium in a specified direction, a head unit mounting an ink jet head, a head unit moving mechanism for moving the head unit reciprocally in a direction orthogonal to the conveying direction of the printing medium, and a controller, in which the controller controls feeding of the printing medium in a specified direction, moving the head unit in a direction of crossing the printing medium, discharging the ink from the head unit toward the printing medium, and printing on the printing medium, and further a blower is provided at least at the backward side in the printing moving direction of the head unit, out of the both sides of the head unit, and the blower has an air injection unit for generating a horizontal air stream in a direction nearly at a right angle to the ink discharge direction toward a direction departing from the adjacent head unit, disposed at the lower side of the blower, and the ink on the printing medium is dried by the horizontal air stream.

The invention also presents an ink jet printing device including a printing medium conveying mechanism having a support surface for supporting a printing medium, for conveying the printing medium in a specified direction, a head unit mounting an ink jet head, a head unit moving mechanism for moving the head unit reciprocally in a direction orthogonal to the conveying direction of the printing medium, and a controller, in which the controller controls feeding of the printing medium in a specified direction, moving the head unit in a direction of crossing the printing medium, discharging the ink from the head unit toward the printing medium, and printing on the printing medium, and further a blower is provided at least at the backward side in the printing moving direction of the head unit, out of the both sides of the head unit, and the blower has an air nozzle for injecting air toward the printing medium, and the bottom of the blower is provided with a wall for bending the air injected from the air nozzle at a right angle by Coanda effect, and generating a horizontal air stream in a direction nearly at a right angle to the ink discharge direction toward a direction departing from the adjacent head unit, and the ink on the printing medium is dried by the horizontal air stream.

The invention is characterized by being provided with a blow control mechanism for controlling blowing and stopping, depending on the moving position of the head unit in a scanning direction in a printing operation, in order to control blowing and stopping of the blower only at a specified position in the head unit scanning direction.

In the invention, the head unit moving mechanism moves the head unit from the waiting position to the printing area and within the printing area reciprocally, and the blower communicates with a solenoid valve opened and closed by the controller, and blowing is started or stopped by opening or closing of the solenoid valve, and the controller controls the solenoid valve as follows: when the head unit is at the waiting position or while moving from the waiting position to the specified printing area, blowing by the blower is stopped, and when the head unit gets into the printing area, blowing by the blower is started, and when the head unit finishes printing on the printing medium, blowing by the blower is stopped.

The invention further presents an ink jet printing device including a printing medium conveying mechanism having a support surface for supporting a printing medium, for conveying the printing medium in a specified direction, a head unit mounting an ink jet head, a head unit moving mechanism for moving the head unit reciprocally in a direction orthogonal to the conveying direction of the printing medium within a printing area and between the printing area and a waiting position, a controller, and a blower communicating with a solenoid valve opened and closed by the controller, for starting or stopping blowing by opening or closing of the solenoid valve, being coupled at least at the backward side in the printing moving direction of the head unit, out of the both sides of the head unit, in which the controller controls feeding the printing medium in a specified direction, moving the head unit in a direction of crossing the printing medium, discharging the ink from the head unit toward the printing surface of the printing medium, and printing on the printing medium, and the blower has an air nozzle for injecting air toward the printing medium, and the bottom of the blower is provided with a wall for bending the air injected from the air nozzle at right angle by Coanda effect, and generating a horizontal air stream in a direction nearly at right angle to the ink discharge direction toward a direction departing from the adjacent head unit, and the controller controls the solenoid valve as follows: when the head unit is at the waiting position or while moving from the waiting position to specified printing area, blowing by the blower is stopped, and when the head unit gets into the printing area, blowing by the blower is started, and when the head unit finishes printing on the printing medium, blowing by the blower is stopped.

In the invention, the blower is provided at both sides of the head unit.

In the invention, an air passage hole is provided between the head unit and the blower for supplying air to be sucked into the horizontal air stream from above them.

In the invention, a shielding member is provided between the head unit and the blower for blocking a negative pressure by the horizontal air stream from coming downward to the head unit.

In the invention, the horizontal air stream is injected from nearly whole region in the longitudinal direction of the blower.

The invention is provided with a filter for removing contamination of air in the air supply route of the blower.

In the invention, the direction of horizontal air stream blown from the blower is nearly parallel to the moving direction of the head unit.

In the invention, the direction of horizontal air stream blown from the blower is oblique to the moving direction of the head unit.

In the invention, the blower and the side of the head unit are coupled by way of a coupler for setting the spacing distance between the blower and the side of the head unit so that the effect of the horizontal air stream may not be applied to the downside of the head unit.

In the invention, the printing area is a specified region wider than the printing medium defined by the printing medium support surface for supporting the printing medium.

In the invention, the printing area is a region defined by the printing medium, and the blowing is limited only to the area above the printing medium.

The invention is designed to send out a horizontal air stream in a direction nearly at a right angle to the ink discharge direction from the blower, and the air blow does not have direct effect on the ink right after printing, and the ink is not shifted to the blowing direction right after printing, and its drying is not promoted in such state.

Besides, since a horizontal air stream generating unit is provided in the bottom of the blower, the horizontal air stream can be easily brought closer to the printing surface. In addition, since the filter acts on the blown air, adverse effects on the ink after printing can be prevented.

By installing the blower obliquely, effects of blowing can be applied to the ink not only right after printing, but also after transfer of the printing medium after printing. Between the head unit and the blower, an air supply region is provided for allowing flow of air from another area than the area beneath the head unit, and effects of air stream by the blower in the area beneath the blower can be lessened, and a favorable printing result is obtained. In the invention, by controlling two states, blowing and stopping, depending on the move of the head unit, scattering of wasteful ink mist or dust in other than printing area can be suppressed, and a favorable printing result may be obtained.

DETAILED DESCRIPTION OF THE INVENTION

The configuration of the invention is specifically described below while referring to the accompanying drawings.

Figure 1:
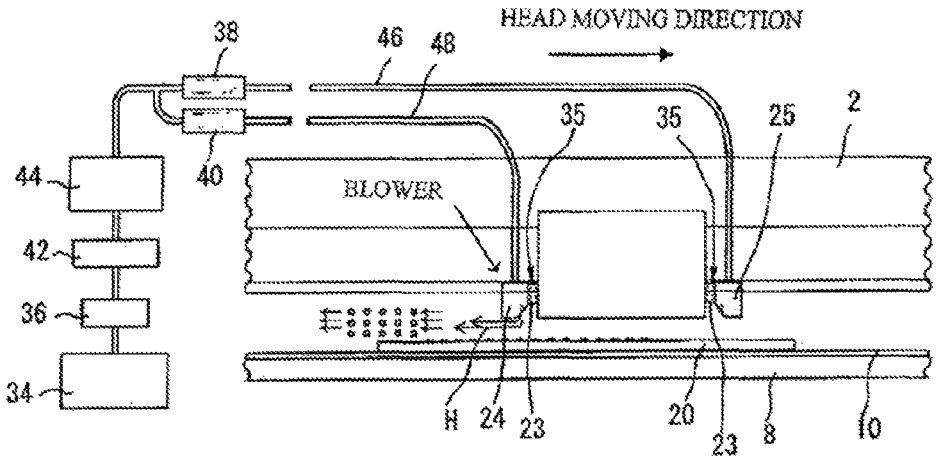
FIG. 1 is an explanatory diagram of ink jet printing device according to the invention.

FIG. 1 is an explanatory diagram of configuration of ink jet printing device of the invention, and the ink jet printing device has a Y-axis rail 2 horizontal to the floor and extending in the Y-axis direction. This Y-axis rail 2 is mounted on a machine frame (not shown) of the ink jet printing device. A head unit 4 is reciprocally coupled to the Y-axis rail 2 along the longitudinal direction of the Y-axis rail 2 by way of a carriage 6.

The base plate of the head unit 4 is provided with a plurality of ink discharge nozzles of ink jet printing head arranged on a same plane in the opening in the bottom of the head unit 4.

Figure 3:
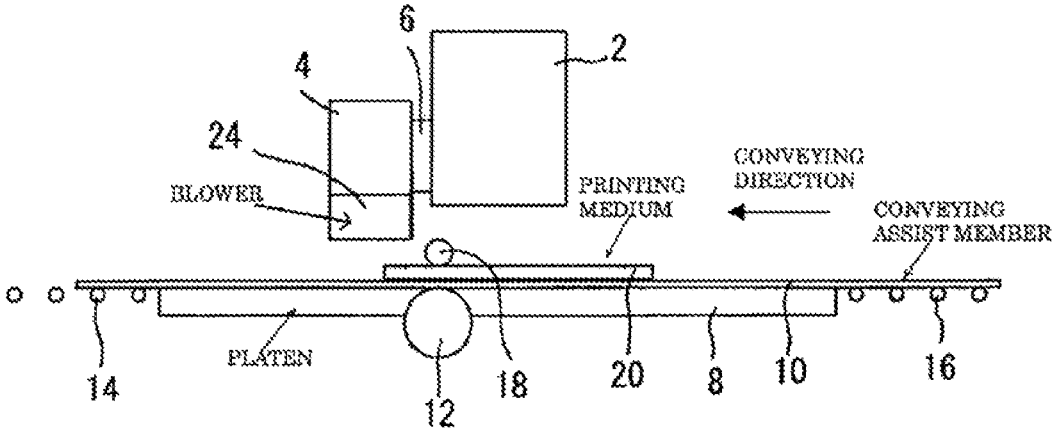
FIG. 3 is an explanatory diagram of ink jet printing device.

A platen (mounting plate) is supported on the machine frame, being positioned beneath the Y-axis rail 2. The platen 8 has a gap (not shown) extending in a direction parallel to the Y-axis rail 2, and as shown in FIG. 3, a drive roller 12 is rotatably disposed for conveying a conveying plate 10 in an X-axis direction orthogonal to the Y-axis rail 2.

The drive roller 12 is linked to an X-axis driving mechanism including a motor controlled by a controller. Conveying plate guide auxiliary mechanisms 14, 16 composed of a plurality of rollers disposed in parallel rows are provided on an extended plane in right-angle direction to the longitudinal direction of the Y-axis rail 2 of the platen 8. At the side of the Y-axis rail 2, a plurality of pressing rollers 18 are supported elevatably to the drive roller 12 by way of roller support members. The head unit 4 is provided with an object detection sensor (not shown) for detecting a printing medium 20 on the conveying plate 10.

Figure 5:
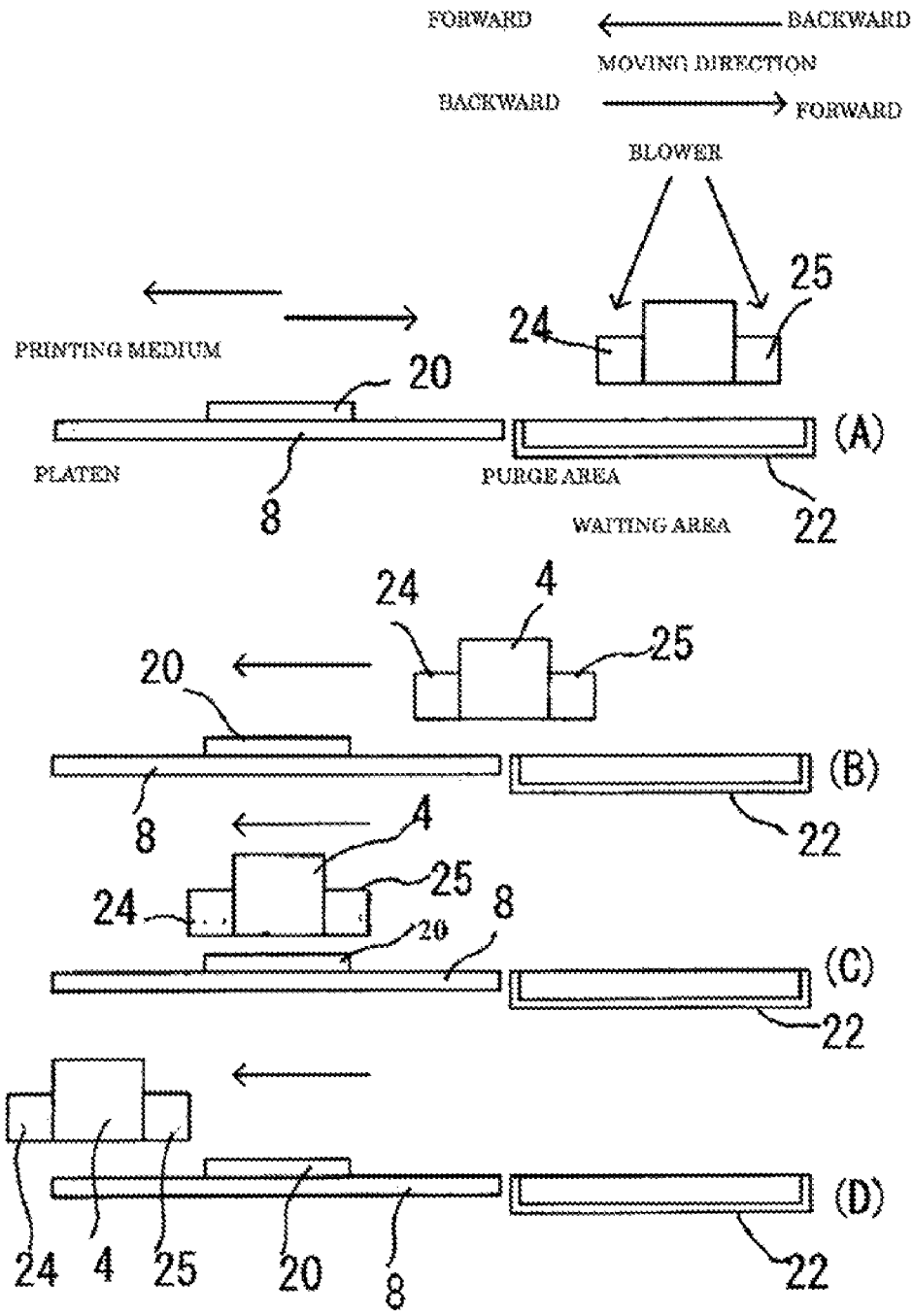
FIG. 5 is an explanatory diagram of operation of ink jet printing device.

The scan moving route along the Y-axis rail 2 of the head unit 4 is, as shown in FIG. 5, provided with home position (waiting position) of the head unit 4 for waiting, at a position remote from the printing region on the platen 8, and the home position is provided with a purge box 22 for maintenance of the nozzles of the ink jet head, such as empty discharging of ink or cleaning of nozzles. While the head unit 4 is waiting at the home position, the nozzles are capped so that the ink in the nozzles may not be dried.

Figure 4:
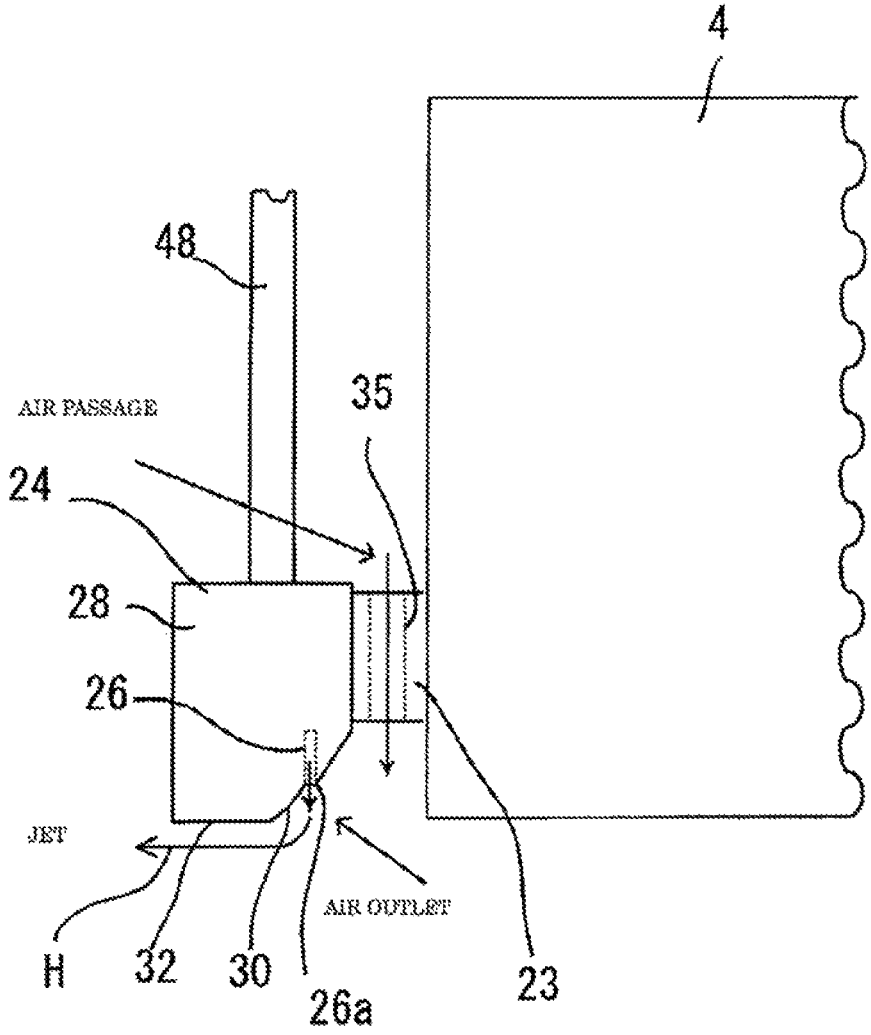
FIG. 4 is an explanatory diagram of ink jet printing device.

At both sides of the head unit 4, blowers 24, 25 are provided by way of a coupler 23 so as to be positioned before and after the print moving direction along the Y-axis rail 2. As shown in FIG. 4, the blowers 24, 25 are provided with air nozzles 26 of thin space perpendicular to a support plate horizontal to the floor of the platen 8 in a device main body 28, and high-pressure air is supplied into the air nozzles 26 from a high-pressure chamber in a device main body 28. Air injection ports 26*a* of the air nozzles 26 are opened to the bottom of the device main body 28.

The bottom wall of the device main body 28 is provided with a curved plane 30 and a parallel plane 32 for changing the flow of compressed air injected from the air injection ports 26*a* of the air nozzles 26 perpendicularly to the support plane of the platen 8 or the conveying plate 10, or the printing plane of the printing medium 20 by Coanda effect, into a direction horizontal to the support plane of the platen 8 or the conveying plate 10 or the printing plane of the printing medium 20 and into an opposite direction toward the head unit 4. The air injection ports 26*a* are in contact with the upper part of the curved plane. The coupler 23 between the blowers 24, 25 and the head unit 4 is provided with an air passage hole 35 for supplying the air above the blowers 24, to lower parts of the blowers 24, 25. FIG. 1 shows an air supply mechanism for supplying air into the blowers 24, 25.

Figure 7:
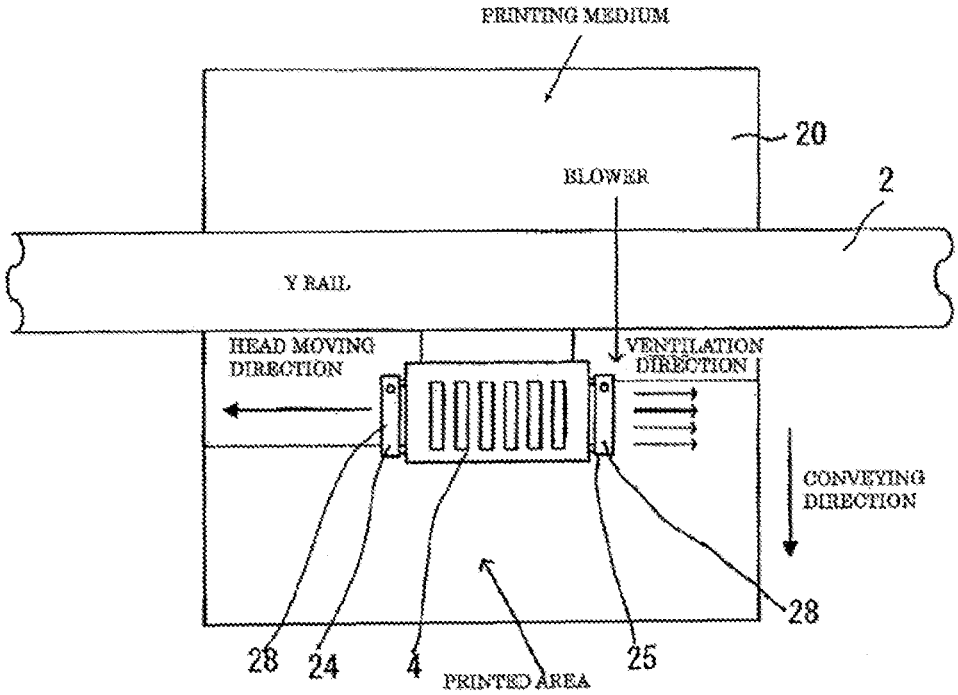
FIG. 7 is a plane explanatory diagram of ink jet printing device.

This air supply mechanism includes an air pressure pump 34 (compressor) disposed at the machine frame side, solenoid valves 36, 38, 40 for opening and closing the air passage as required, a filter 42 for removing foreign matter from air, and a regulator 44 for adjusting the air pressure to a specific value, and these components are coupled by way of tubes. The tubes 46, 48 coupled to the output ports of the solenoid valves 38, 40 respectively are coupled to air inlets of the device main body 28 of the corresponding blowers 24, 25 by way of couplers, and the air pumped from the pump 34 is supplied into the high-pressure chamber in the device main body 28 by way of the solenoid valves 38, 40. The blowers 24, 25 send out horizontal air streams from the nearly entire region in the longitudinal direction of the device main body 28 as shown in FIG. 7. The distribution range of the horizontal air stream is nearly same as the printing width of the head unit 4 in the embodiment, but the distribution range of the horizontal air stream, that is, the width of the air nozzles 26 may be also wider than the printing width.

The printing device has a controller, and this controller controls the drive units such as drive roller 12, head unit 4, air supply mechanism, and head unit moving mechanism, so as to print on the printing medium 20 on the conveying plate 10, and the storage device of the controller stores printing programs and blower control programs.

The printing operation of the printing device is explained below.

A printing medium 20 like a plate is set on the conveying plate 10, and the printing medium 20, together with the conveying plate 10, is held between the drive roller 12 and pressing roller 18 as shown in FIG. 3. In this state, by control from the controller, the drive roller 12 is rotated intermittently in counterclockwise direction in FIG. 3, and the printing medium 20 is sent in the left direction in FIG. 3. On the other hand, by control from the controller, the head unit 4 is sent in a direction orthogonal to the conveying direction of the printing medium 20 along the Y-axis rail 2, and the ink is discharged from the nozzles of the ink jet head mounted on the head unit 4 to the support plane of the platen 8 or conveying plate 10 or the printing plate of the printing medium 20, and is thereby printed on the printing medium 20 on the conveying plate 10. In carrying out the invention, not particularly limited to the printing device using the conveying plate, various other printing devices may be used, such as the printing device for printing on printing medium such as roll paper or cut paper, and other printing devices using rotary drum and others as platen, and the invention is not particularly limited to the configuration of the illustrated printing device.

During the printing operation, as shown in FIG. 1, the blower 24 at the backward side is controlled and driven by the controller in the moving direction of the head unit 4. The air injected from the air injection ports 26*a* of the air nozzles 26 of the blower 24 is controlled by the curved plane 30 and the parallel plane 32 formed on the wall of the device main body 28, and is formed into a horizontal air stream H flowing above the printing surface of the printing medium 20, in a direction parallel to the support plane or the printing plate of the printing medium 20, and in a direction opposite to the moving direction of the head unit 4.

Figure 2:
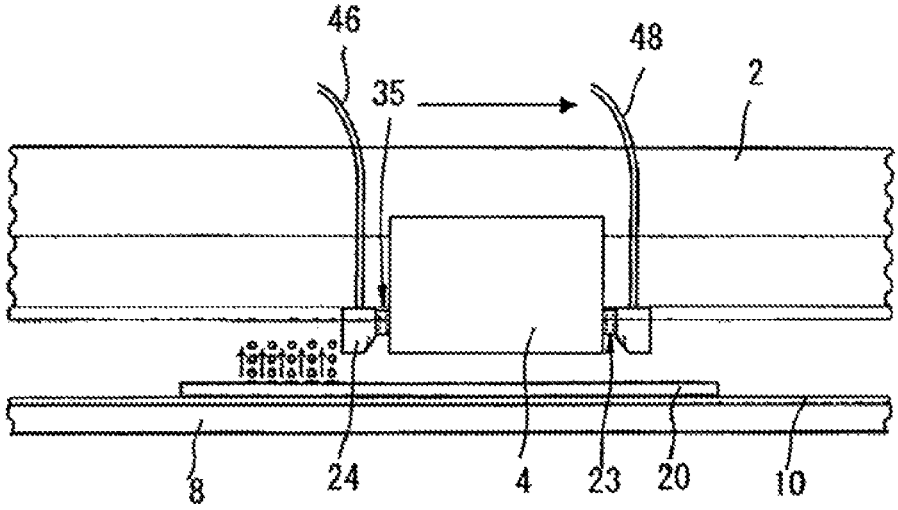
FIG. 2 is an explanatory diagram of ink jet printing device.

By this horizontal air stream H, the air around the air injection ports 26*a* is attracted to the horizontal air stream, and a negative pressure is caused, but this negative pressure is absorbed by sucking the air from the air passage hole 35 provided between the head unit 4 and the device main body 28. As a result, effects of negative pressure due to generation of horizontal air stream H are prevented from acting to the downside of the head unit 4, and air stream is not generated due to suction of the downside air of the head unit 4 to the horizontal air stream by the blower 24. The horizontal air stream H generated on the printing plane promotes evaporation of solvent (dissolving medium) of ink right after printing as shown in FIG. 2, and the time required for solidification of ink is shortened.

Figure 9:
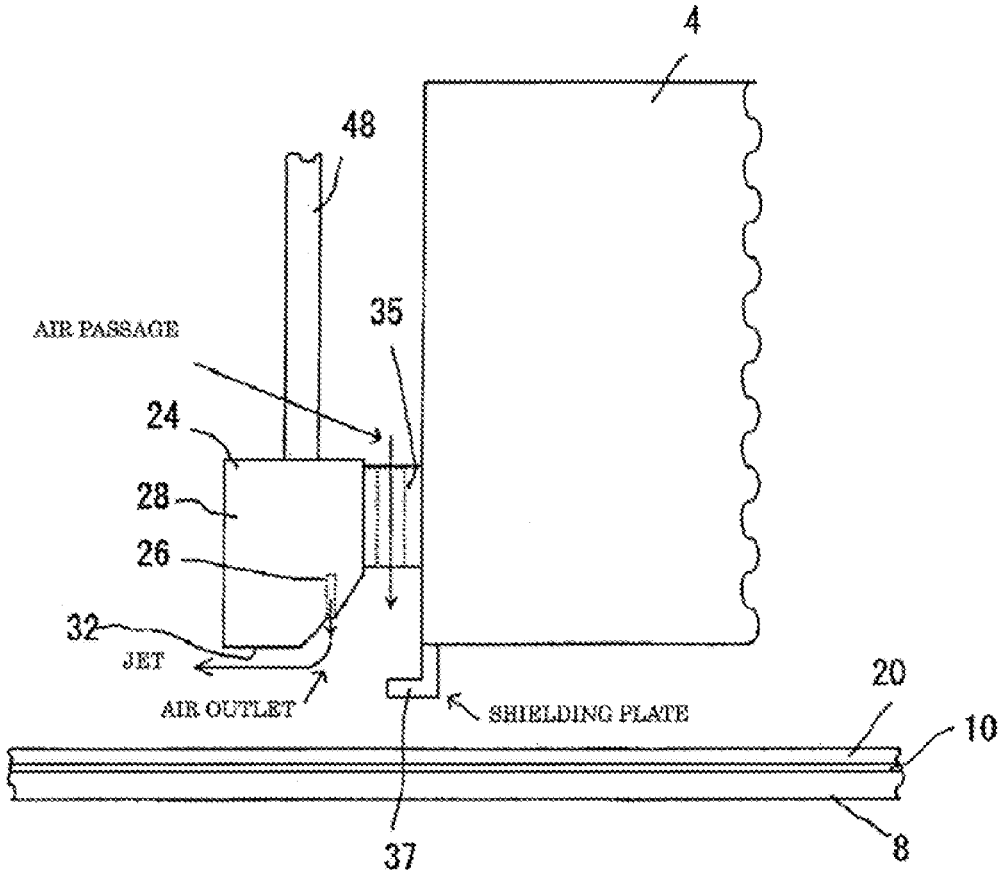
FIG. 9 is a side explanatory diagram of other embodiment of ink jet printing device.

By the negative pressure due to generation of horizontal air stream H, generation of downward flow of air in the head unit 4 may be prevented by proper means as shown in FIG. 9, that is, in addition to the configuration of the air passage hole 35, a shielding member 37 such as partition may be provided between the blowers 24, 25 and the head unit 4. By this shielding member 37, generation of downward flow of air by the negative pressure due to generation of horizontal air stream H in the head unit 4 is prevented and effects on the ink discharge are avoided, and also drying of the nozzles near the blower 24 of the head unit 4 is prevented.

Figure 10:
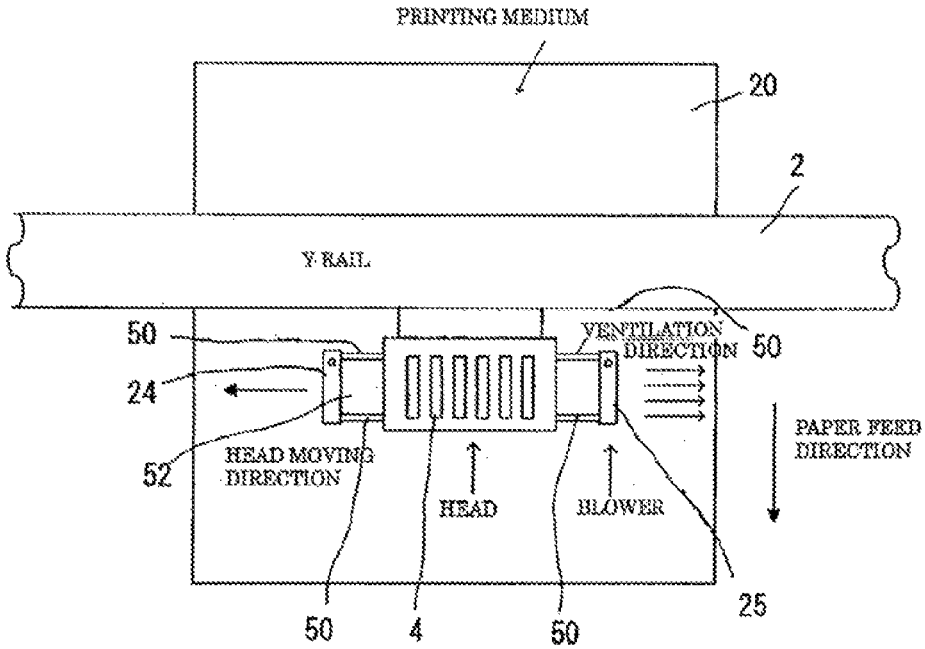
FIG. 10 is a plane explanatory diagram of other embodiment of ink jet printing device.

Also as shown in FIG. 10, the head unit 4 and the blowers 24, 25 are coupled by couplers 50 long in horizontal direction, and the opposing distance of the head unit 4 and the blowers 24, is extended, so that effects of negative pressure due to generation of horizontal air stream H may be suppressed from acting on the downside of the head unit 4. In the embodiment shown in FIG. 10, the blowers 24, 25 and the head unit 4 are widely apart, and between the opposite ends of the couplers 50, 50, a gap 52 is formed as air passage hole for supplying the air to be attracted to the horizontal air stream from above, and effects of negative pressure of the blowers 24, 25 on the head unit are further suppressed.

Figure 6:
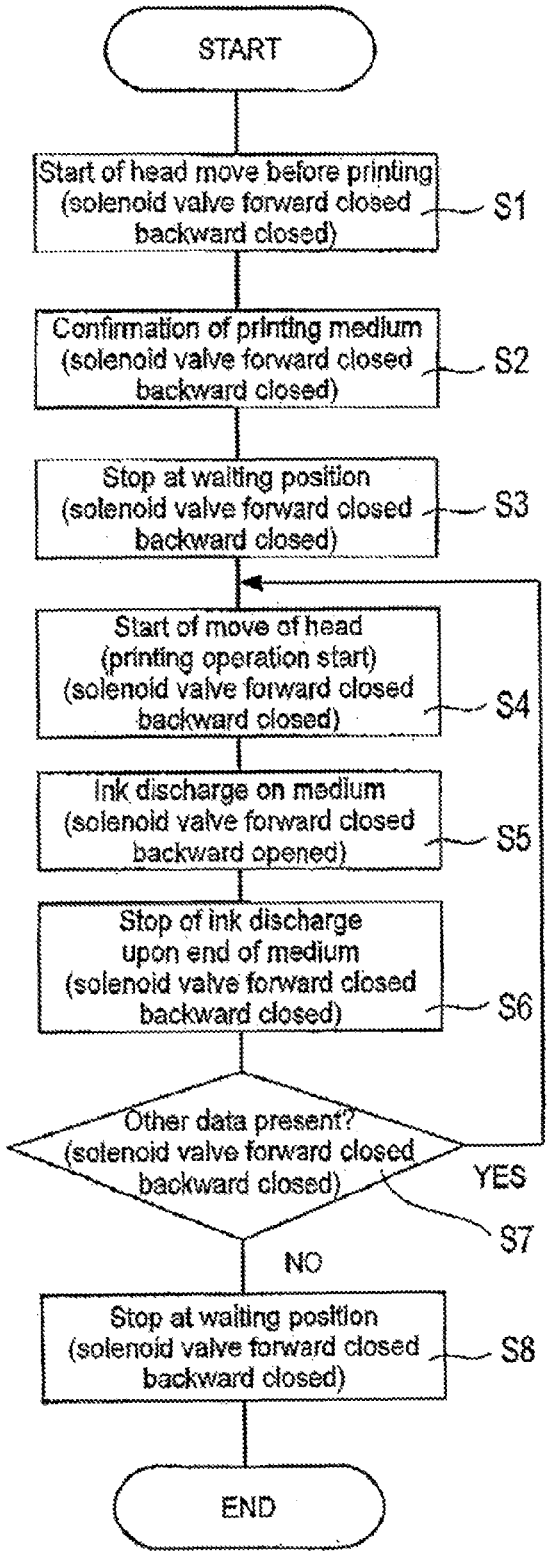
FIG. 6 is a flowchart of operation of ink jet printing device.

Referring now to the flowchart in FIG. 6, the control operation of the blower by the controller is explained below.

When the printing device comes to the print mode, the head unit 4 is controlled by the controller to start to move in the left direction in FIG. 5, from the waiting position (purge area) shown in FIG. 5, along the Y-axis rail 2 (step 1). At this time, the pump 34 is in power-on state. By the controller, the solenoid valve 36 is set in open state, and the solenoid valves 38, 40 are set in closed state, and the forward blower 24 and the backward blower 25 of the head unit 4 are both stopped in the moving direction before printing.

Next, the head unit 4 moves above the printing medium 20, and the printing medium 20 is scanned by an object detection sensor. As a result, the controller recognizes the position of the printing medium 20 (step 2). The head unit 4 moves in the right direction along the Y-axis rail 2 in FIG. 5, and returns to the waiting position away from the printing area, and stops at this position (step 3) (see FIG. 5A). When the head unit 4 stops at this waiting position, the output ports of the solenoid valves 38, 40 are both held in closed state.

Consequently, the head unit 4 begins to move in the left direction toward the printing medium 20, from the waiting position in FIG. 5, while the blowers 24, 25 are held in blowing stopped state (step 4) (see FIG. 5B). Next, as shown in FIG. 5C, the head unit 4 discharges ink on the printing medium 20, and starts a printing action on the printing plane of the printing medium 20. Simultaneously with start of printing action, the controller opens the output port of the solenoid valve 38, and starts blowing from the backward side blower 25 in the printing moving direction of the head unit 4 (step 5).

At this time, in the printing moving direction of the head 4, the forward side blower 24 is stilled stopped in blowing. During printing, the head unit 4 moves on the printing medium 20 while discharging ink, and moves in the right direction along the Y-axis rail 2 as shown in FIG. 1 and FIG. 2, and the controller closes the output port of the solenoid valve 38, and opens the output port of the solenoid valve 40, and thereby selects the backward side blower 24 in the printing moving direction of the head unit 4, and the blower 24 is started, while the forward blower 25 is stopped. When printing on the printing medium 20 is finished, the controller stops the ink discharge operation of the head unit 4 (step 6).

At this time, the controller closes the solenoid valve 36 and both solenoid valves 38 and 40, and stops the both blowers 24, 25. While closing the solenoid valve 36 or both solenoid valves 38 and 40, the controller judges if there is print data in the memory or not (step 7), and when judged affirmatively, back to step 4, the printing operation is started, or when judged negatively, while closing the solenoid valve 36 or both solenoid valves 38 and 40, the head unit 4 is moved to the waiting position and stopped at the waiting position (step 8), and the printing operation is terminated.

In the case of one-side printing, that is, printing is made only when the head unit 4 moves in one direction, out of two directions in FIG. 1 along the Y-axis rail 2, not printing in other direction, the blower is required only at the backward side of the printing moving direction of the head unit 4, and the blower is not required at both sides of the head unit 4. Or, during printing at step 5, the both solenoid valves 38, 40 may be opened, and the both blowers 24, 25 at both sides of the head unit 4 may be operated, so that the ink on the printing surface may be promoted.

Figure 8:
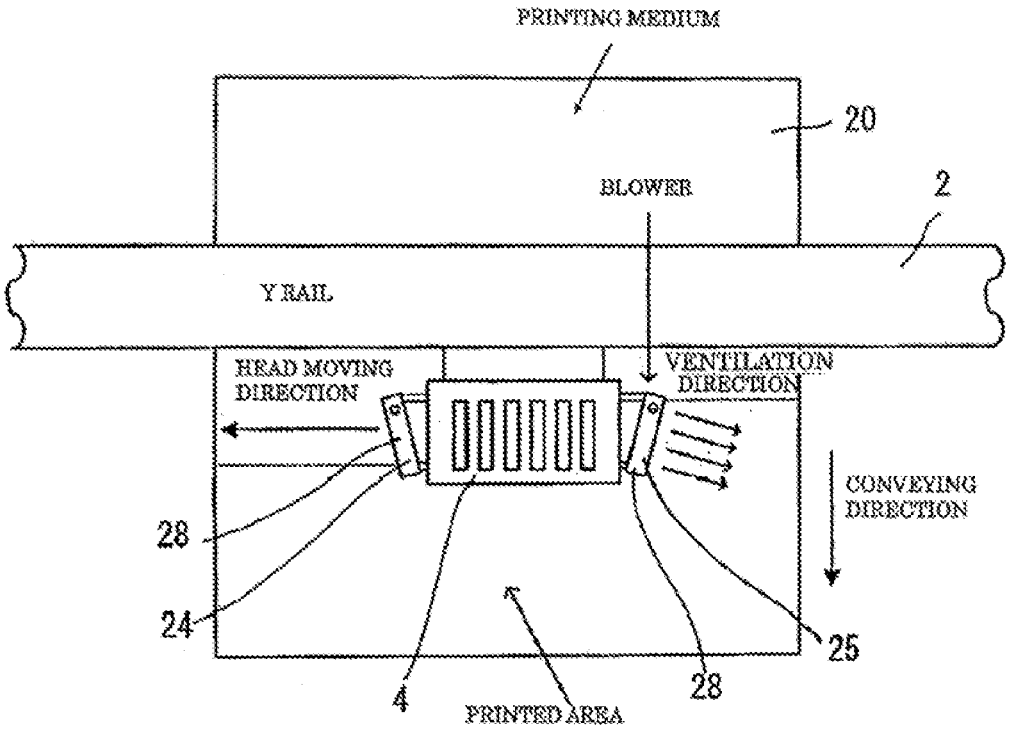
FIG. 8 is a plane explanatory diagram of other embodiment of ink jet printing device.

In the embodiment shown in FIG. 1, the blowers 24 and 25 at both sides of the head unit 4 are identical in structure, and the right and left couplers 35 coupling them to the head unit 4 are mutually identical structure, and the both sides of the head unit 4 are symmetrical side by side in FIG. 1. In the embodiment, as shown in FIG. 7, the longitudinal direction of the device main body 28 is set in parallel to the conveying direction of the printing medium 20, and the blowing direction of the blowers 24, 25 is set in parallel to the moving direction of the head unit 4, but as shown in FIG. 8, the longitudinal direction of the device main body 28 may be inclined to the conveying direction of the printing medium 20, and the blowing direction of the blowers 24, 25 may be inclined to the moving direction of the head unit 4. In FIG. 8, the blowing direction of the blower 25 is indicated by arrows. By this configuration, as shown in FIG. 8, the backward blower 25 in the print scan moving direction in left direction in the drawing of the head unit 4 (or the blower 24 when the head unit 4 scans and moves in the right direction) may apply effects of blowing not only on the ink right after printing, but also on the ink after the printing medium 20 is conveyed after printing.

The ink jet printing device of the invention having such configuration as described herein is very useful when printing on printing medium of large size made of material hardly allowing permeation of ink such as resin or plastics, and it is suited to a large-sized ink jet printing device desired to fix the ink promptly on the printing medium.

What is claimed is:

1. An ink jet printing device, comprising:

a printing medium conveying mechanism having a support surface configured to support a printing medium, and being configured to convey the printing medium in a specified direction;

a head unit mounting an ink jet head;

a head unit moving mechanism configured to move said head unit reciprocally in a direction orthogonal to the specified direction of the printing medium; and a controller, wherein said controller is configured to control feeding of the printing medium in the specified direction, moving said head unit in a direction of crossing the printing medium, discharging ink in a direction from said head unit toward the printing medium, and printing on the printing medium, and wherein a blower is disposed at least at a backward side in a printing moving direction of said head unit, out of both sides of said head unit, and said blower has an air injection unit configured to generate a horizontal air stream in a direction nearly at a right angle to the ink discharge direction toward a direction departing from an adjacent head unit, disposed at a lower side of the blower, wherein said ink jet printing device is configured to dry the ink on the printing medium by the horizontal air stream, and wherein said head unit moving mechanism is configured to move said head unit from a waiting position to a printing area and within the printing area reciprocally, and said blower is configured to communicate with a solenoid value opened and closed by said controller, and blowing is startable or stoppable by opening or closing of said solenoid valve, and said controller is configured to control said solenoid valve by stopping blowing by the blower when said head unit is at the waiting position or while moving from the waiting position to a specified printing area, starting blowing by said blower when said head unit is in the printing area, and stopping blowing by said blower when said head unit finishes printing on the printing medium.

2. The ink jet printing device of claim 1, further comprising:

a blow control mechanism for controlling blowing and stopping, depending on a moving position of said head unit in a scanning direction in a printing operation, so as to control blowing and stopping of the blower only at a specified position in the head unit scanning direction.

3. The ink jet printing device of claim 1, wherein said blower is provided at both sides of said head unit.

4. The ink jet printing device of claim 1, wherein an air passage hole is disposed between said head unit and said blower for supplying air to be sucked into the horizontal air stream from above said head unit and said blower.

5. The ink jet printing device of claim 1, wherein a shielding member is disposed between said head unit and said blower for blocking a negative pressure by the horizontal air stream from coming downward to said head unit.

6. The ink jet printing device of claim 1, wherein the horizontal air stream is injected from nearly an entire region in the longitudinal direction of said blower.

7. The ink jet printing device of claim 1, wherein the direction of horizontal air stream blown from said blower is nearly parallel to the moving direction of said head unit.

8. The ink jet printing device of claim 1, wherein the direction of horizontal air stream blown from said blower is oblique to the moving direction of said head unit.

9. The ink jet printing device of claim 1, wherein said blower and a side of said head unit are coupled by coupler configured to set a spacing distance between said blower and said side of said head unit so that the effect of the horizontal air stream may not be applied to a downside of said head unit.

10. An ink jet printing device, comprising:

a printing medium conveying mechanism having a support surface configured to support a printing medium, and being configured to convey the printing medium in a specified direction;

a head unit mounting an ink jet head;

a head unit moving mechanism configured to move said head unit reciprocally in a direction orthogonal to the specified direction of the printing medium; and a controller, wherein said controller is configured to control feeding of the printing medium in the specified direction, moving said head unit in a direction of crossing the printing medium, discharging ink from said head unit toward the printing medium, and printing on the printing medium, and a blower is disposed at least at a backward side in a printing moving direction of said head unit, out of both sides of said head unit, and said blower has an air nozzle configured to inject air toward the printing medium, and a bottom of said blower is provided with a wall configured to bend the air injected from said air nozzle at a right angle by Coanda effect, and generate a horizontal air stream in a direction nearly at a right angle to an ink discharge direction toward a direction departing from an adjacent head unit, and the ink on the printing medium is capable of being dried by the horizontal air stream, and wherein said head unit moving mechanism is configured to move said head unit from a waiting position to a printing area and within the printing area reciprocally, and said blower is configured to communicate with a solenoid value opened and closed by said controller, and blowing is startable or stoppable by opening or closing of said solenoid valve, and said controller is configured to control said solenoid valve by stopping blowing by said blower when said head unit is at the waiting position or while moving from the waiting position to a specified printing area, starting blowing by said blower when said head unit is in the printing area, and stopping blowing by said blower when said head unit finishes printing on the printing medium.

11. An ink jet printing device, comprising:

a printing medium conveying mechanism having a support surface configured to support a printing medium, and being configured to convey the printing medium in a specified direction;

a head unit mounting an ink jet head;

a head unit moving mechanism configured to move said head unit reciprocally in a direction orthogonal to the specified direction of the printing medium within a printing area and between the printing area and a waiting position;

a controller; and a blower configured to communicate with a solenoid valve opened and closed by said controller, for starting or stopping blowing by opening or closing of said solenoid valve, being coupled at least at a backward side in a printing moving direction of said head unit, out of both sides of said head unit, wherein said controller is configured to control feeding of the printing medium in the specified direction, moving said head unit in a direction of crossing the printing medium, discharging ink from said head unit toward the printing surface of the printing medium, and printing on the printing medium, and said blower has an air nozzle configured to inject air toward the printing medium, and a bottom of said blower is provided with a wall configured to bend the air injected from said air nozzle at a right angle by Coanda effect, and generate a horizontal air stream in a direction nearly at a right angle to an ink discharge direction toward a direction departing from an adjacent head unit, and said controller is configured to control said solenoid valve so that when said head unit is at a waiting position or while moving from the waiting position to a specified printing area, blowing by said blower is stopped, and when said head unit gets into the printing area, blowing by said blower is started, and when said head unit finishes printing on the printing medium, blowing by said blower is stopped.

12. The ink jet printing device of claim 11, further comprising:

a filter configured to remove contamination of air in the air supply route of said blower.

13. The ink jet printing device of claim 11, wherein the printing area is a specified region wider than the printing medium defined by the printing medium support surface for supporting the printing medium.

14. The ink jet printing device of claim 11, wherein the printing area is a region defined by the printing medium, and the blowing is limited only to the area above the printing medium.

* * * * *